US010724194B1

(12) United States Patent
Hogan

(10) Patent No.: US 10,724,194 B1
(45) Date of Patent: Jul. 28, 2020

(54) ENERGY CONSERVING WHEELED SHOVEL

(71) Applicant: Theresa Hogan, Easton, PA (US)

(72) Inventor: Joseph M. Hogan, Easton, PA (US)

( * ) Notice: Subject to any disclaimer, the term of this patent is extended or adjusted under 35 U.S.C. 154(b) by 0 days.

(21) Appl. No.: 15/973,432

(22) Filed: May 7, 2018

Related U.S. Application Data

(63) Continuation-in-part of application No. 13/438,215, filed on Apr. 3, 2012, now abandoned.

(51) Int. Cl.
*E01H 5/02* (2006.01)

(52) U.S. Cl.
CPC ..... *E01H 5/02* (2013.01)

(58) Field of Classification Search
CPC .... E01H 5/02; A01B 1/00; A01B 1/02; A01B 1/022; A01B 1/028; A01B 3/02
USPC ..... 37/264, 265, 278, 284, 270, 285, 266, 37/271; 294/53.5, 49, 54.5, 176
See application file for complete search history.

(56) References Cited

U.S. PATENT DOCUMENTS 237,410 A * 2/1881 Rouse ..... A01D 31/00 171/100
909,521 A * 1/1909 Bearinger ..... A01B 43/00 171/86
996,596 A * 6/1911 Lindner ..... B62B 1/147 37/434
2,441,449 A * 5/1948 Shaw ..... 298/2
2,520,606 A * 8/1950 McLoughlin ..... E01H 5/02 172/358
2,552,951 A * 5/1951 Freeman ..... A01D 34/82 56/17.2
2,846,785 A * 8/1958 Underwood ..... E02F 3/02 294/54.5
3,014,329 A * 12/1961 Cizek ..... A01D 34/63 56/11.6
3,748,761 A * 7/1973 Chetwynde ..... E01H 5/02 280/47.26
3,751,094 A * 8/1973 Bohler ..... A01B 1/026 16/426
3,971,196 A * 7/1976 Stevenson ..... A01D 34/63 56/17.1
4,945,717 A * 8/1990 Schaffer ..... A01D 34/001 56/17.1
5,054,278 A * 10/1991 Thorndike ..... A01B 1/00 280/47.3
5,279,102 A * 1/1994 Foster ..... A01D 34/001 56/12.7
D347,368 S * 5/1994 Gedert ..... D8/8
5,459,985 A * 10/1995 Gedert ..... A01D 34/001 30/296.1
5,487,202 A * 1/1996 Cowan ..... A47L 13/254 15/147.1
5,581,915 A * 12/1996 Lobato ..... E01H 5/02 280/47.34
5,669,651 A * 9/1997 Vroegindewey ..... A01B 1/028 254/131.5

(Continued)

*Primary Examiner* — Thomas B Will
*Assistant Examiner* — Joan D Misa
(74) *Attorney, Agent, or Firm* — Wilkinson Law Office; Clinton H. Wilkinson; Charles A. Wilkinson

(57) ABSTRACT

A wheeled snow shovel is provided with a rotation about two intersecting axis to allow shoveling of snow at one location and discharge of the picked up snow and discharge of snow at a different point by rotation of the shovel with a sidewise rotation.

14 Claims, 8 Drawing Sheets

(56) References Cited

U.S. PATENT DOCUMENTS 5,782,518 A * 7/1998 Scruggs ..... A01B 1/02 15/143.1
5,918,921 A * 7/1999 Samuelson ..... E01H 5/02 294/54.5
6,601,887 B2 * 8/2003 Graves ..... A01B 1/026 294/58
6,735,887 B1 * 5/2004 Muzzammel ..... E01H 5/02 37/285
6,862,871 B2 * 3/2005 Morabit ..... A01D 34/416 56/12.7
7,111,418 B2 * 9/2006 Noonan ..... B62B 1/147 294/54.5
D568,122 S * 5/2008 Noonan ..... D8/10
7,631,443 B2 * 12/2009 Noonan ..... A01B 1/02 37/265
D607,901 S * 1/2010 Hartman ..... D15/14
7,681,336 B2 * 3/2010 Noonan ..... B62B 1/147 294/54.5
7,699,404 B2 * 4/2010 Noonan ..... B60B 1/06 152/396
D652,273 S * 1/2012 Hogan ..... D8/13
8,100,626 B2 * 1/2012 Shai ..... B66F 3/46 414/607
8,136,268 B2 * 3/2012 Noonan ..... E01H 5/02 37/265
8,166,677 B1 * 5/2012 Woyak ..... E01H 5/02 294/54.5
9,187,872 B1 * 11/2015 Hermanson ..... E01H 5/02
9,204,587 B2 * 12/2015 Cordeiro ..... E01H 5/02
2005/0160632 A1 * 7/2005 Williams ..... B62B 1/147 37/265
2007/0214686 A1 * 9/2007 Shai ..... B66F 3/46 37/411
2007/0227048 A1 * 10/2007 Adinata ..... E01H 5/02 37/285
2008/0012369 A1 * 1/2008 Helton ..... A01B 1/028 294/49
2009/0184527 A1 * 7/2009 Marion ..... B25G 1/102 294/54.5

* cited by examiner

ENERGY CONSERVING WHEELED SHOVEL

FIELD OF THE INVENTION

The present invention relates to snow shoveling devices and more particularly to a leverage device for mechanizing the shoveling and removal of snow while minimizing strain on the shoveler's back during such shoveling, whereby shoveling is rendered easier and more efficient by the use of a wheeled support equipped with a rotatable mounting to allow for controlled lifting and dumping to the side of a load of snow accumulated on the shovel blade.

BACKGROUND OF THE INVENTION

Shovels for digging in the ground as well as manually lifting and moving particulate material have been used for what can be reasonably referred to as "ages." Perhaps the best known shovel is the conventional spade shaped shovel having a curved blade which is widely used for digging in and moving earth, or the recently ubiquitous coal shovel used for shoveling coal from a coal bin into a heating furnace or firebox of coal stoked steam engines. Coal shovels are designed for scraping along a flat surface, and, unlike shovels for digging in the ground, usually have flat bottoms, plus low sides to self limit the load picked up. It is not surprising then that the conventional coal shovel was in earlier times frequently used to shovel pavements and road surfaces which are also usually desirably flat.

Coal stokers such as "firemen" on trains and "stokers" on ships who "stoked" coal on a regular basis tended to develop strong muscles in their backs and shoulders which could stand up to persistent shoveling. Snow shoveling, however, is performed by most only on an intermittent or as required basis, particularly in the temperate climates. Local government regulations generally require outdoor surfaces such as footpaths, pavements, driveways and the like to be cleared by the owners, many of whom seldom otherwise lift heavy loads and have weak muscles and thus are prone to musculoskeletal strains, especially to the lower back, shoulders, arms, and knees, as well as other physiological maladies from shoveling. Such maladies not infrequently can lead to long term injuries such as slipped discs in the spinal column and progressing into other physical symptoms which can at times be seriously debilitating and cause physical incapacitation due to accompanying pain and other medical problems. In addition, it is well known that strenuous shoveling can cause a sudden increase in blood pressure and heart rate, while the cold constricts the blood vessels and decreases oxygen to the heart, which together can trigger a heart attack, particularly in those with existing risk factors or a sedentary lifestyle.

Not surprisingly, therefore, inventions have been described in patent documents and the literature in general to make snow shoveling easier and to prevent the suffering and expense that such injuries often result in. All kinds of innovations with respect to handle structures, lifting blades and other arrangements for snow shovels have been described and used with varying success. For example, most snow shovels are now made using lighter materials, such as plastic and aluminum, and in general are more ergonomically designed. Nevertheless, there remains a need for a snow shoveling device that further reduces the amount of physical exertion required in manual shoveling and which maximizes the use of mechanical force and leverage to lift and dump loads of snow.

DESCRIPTION OF THE PRIOR ART

The following specific examples of earlier mechanically leveraged wheeled shovels and snow ploughs are known to the present inventor as arguably disclosing isolated aspects of his improved snow shovel.

U.S. Pat. No. 996,596 issued to C. H. Lindner on Jun. 27, 1911, entitled "Grain Scoop", discloses a grain scoop which might conceivably also be used as a snow scoop for pavements and the like. It incorporates two large wheels and allows the scoop to be lowered closer to the floor when being filled and then raised to facilitate tilting to prevent spilling of the grain.

U.S. Pat. No. 2,470,217 issued to A. J. McLoughlin on May 17, 1949, entitled "Snow Shovel", discloses a wheeled snow shovel having a straight handle with two offset extensions with handgrips at the ends as well as a hinged shovel blade. McLoughlin describes two small wheels mounted upon an axle connected to the shovel handle by a rod-type extension. The wheel diameter is far less than the length of the extension, which is undesirable in snow and also places the fulcrum for the carriage too low to be mechanically efficient.

U.S. Pat. No. 2,520,606 also issued to A. J. McLoughlin on Aug. 29, 1950, entitled "Portable Shovel", is similar to the earlier McLoughlin device but mounts the shovel section so it can be rotated rather than being hinged, and has a foot pedal. The wheels of McLoughlin are again quite small and thus not very desirable in a wheeled snow shovel. In addition, the width of the shovel blade is greater than the length of the wheel axle, which could result in an overly heavy and unbalanced load.

U.S. Pat. No. 3,107,446 issued to F. C. Messinger on Oct. 22, 1963, entitled "Portable Snow Remover", discloses a shovel blade mounted upon a wheeled carriage having fairly small wheels plus a mechanical arrangement for adjusting and forward dumping the blade.

U.S. Pat. No. 3,748,761 issued to C. H. Chetwynde on Jul. 31, 1973, entitled "Snow Handling Device", discloses a shovel mounted on a two-wheeled carriage also having small wheels and incorporating a two point support for the shovel handle. The main support for the shovel handle is a jack device, and handle can be rotated but its axial movement is said to be limited by a second attachment to the wheels.

U.S. Pat. No. 4,161,073 issued to W. Oakes on Jul. 17, 1979, entitled "Snow Scoop", discloses a wheeled hand truck assembly which pivotably supports the scoop. It is stated that the handles and wheels can be a part of a usual handcart. The scoop is shown in at least one view folded back against the handle of the handcart.

U.S. Pat. No. 4,179,828 issued to F. Brunty on Dec. 25, 1979, entitled "Multi-Purpose Labor Saver Hand Tool", discloses a large single wheel supporting a plough type snow removal device (see FIG. 1 and FIG. 6). The Brunty arrangement clearly does not require a tilting handle to dump the snow, but may be difficult to maintain upright when loaded with snow on its blade.

U.S. Pat. No. 4,214,385 issued to B. Baranowski et al. on Jul. 29, 1980, entitled "Apparatus for Taking Up and Removing Matter From A Surface", discloses a wheeled accessory for addition to or attachment to an existing snow shovel to allow the shovel to be moved against a layer of snow on a surface while supported upon the wheels. It is stated that the wheels are designed so as when attached to the shovel to hold the shovel at the correct angle for picking up snow on the blade.

U.S. Pat. No. 5,048,206 issued to W. S. Jones on Sep. 17, 1991, entitled "Combined Snow Shoveling Device and Cart", discloses a four wheel hand plough with forward dumping ability and which appears rather similar to a hand operated road scoop.

U.S. Pat. No. 5,054,278 issued to C. E. Thorndike on Oct. 8, 1991, entitled "Operation of Long-Handled Tools", discloses various wheel supports for straight handled implements such as shovels and rakes. In some embodiments there is an actual carriage arrangement, but in others there is merely a supporting axle with an extension. See in particular FIGS. 2 and 6 showing a shovel arrangement. The arrangement in FIG. 2 apparently allows the straight handled shovel to be turned if the setscrew in the sleeve 21 is loosened, but unlike embodiments of the present invention the position of the sleeve is adjustable along the length of the handle.

U.S. Design Pat. No. D375,235 issued to K. J. Spear et al. on Nov. 5, 1996, entitled "Sleigh Shovel With Wheels", discloses a sleigh type shovel or scoop for snow.

U.S. Pat. No. 6,050,576 issued to T. J. Tanner et al. on Apr. 18, 2000, entitled "Ground Level Loading Cart", discloses a wheeled shovel or scoop.

U.S. Pat. Pub. No. 2005/0160633 issued to M. Noonan on Jul. 28, 2005, entitled "Wheeled Shovel", discloses a single wheeled snow shovel comprising one large wheel plus a curved handle mounted on the axle on both sides and outlining a shovel surface at the bottom and a handle at the other end. Presumably the entire wheeled device can be tilted to aid emptying the shovel blade.

U.S. Pat. No. 6,735,887 issued to M. M. Muzzammel on May 18, 2004, entitled "Manual Snow Plough", discloses a two wheel carriage mounting a blade in the front apparently formed of a plastic composition. Special care is taken in FIG. 2 to indicate the wheels are mounted within the width of the blade on the front so the scoop in front is in effect clearing a path within which the entire plough arrangement can move.

U.S. Pat. No. 7,699,404 issued to M. Noonan et al. on Apr. 20, 2010, entitled "Wheel Assemblies", discloses a large single wheeled plough or snow shovel mounted on a single wheel. Most of the disclosure is directed to the construction of the large wheel.

Comparing the present inventor's wheeled shovel with the above described prior patent disclosures, the present inventor's apparatus may be described as a straight handled snow shovel mounted upon a two wheeled handcart or dolly arrangement which incorporates large wheels which can be easily propelled in snowy conditions and including a rotary arrangement for the straight handled shovel. A hand grip assembly including a gripping portion shaped somewhat like half a steering wheel is mounted at the apex or end of the shovel handle which provides different gripping areas to facilitate pushing, turning, and otherwise maneuvering the shovel handle. In addition, the structure of the shovel assembly is designed such that the shovel handle or shaft is prevented from lateral sliding with respect to the carriage during use, while simultaneously allowing full circumferential rotation of the handle in either a clockwise or counterclockwise direction to facilitate dumping a load of snow on the blade while retaining the device in a properly balanced and maximum leverage position. The entire arrangement and design as explained hereinafter provides an unexpectedly improved operation which is believed to be far superior to any previously available manually leveraged device.

BRIEF DESCRIPTION OF THE INVENTION

An improved wheeled snow shovel assembly is provided to more quickly and with less stress on or physical exertion by the user remove snow and slush from surfaces such as sidewalks, driveways, porches, and the like. The present inventor's snow shovel assembly includes a two wheeled cart or carriage arrangement which is easily manipulated to manually collect and remove snow from the surface to be shoveled. While gripping the hand grip assembly the shovel blade can be depressed to ground level and the carriage pushed forwardly on the wheels to gather snow on to the shovel blade. The shovel blade is then raised upwardly and/or pulled rearwardly by pushing down and/or pulling on the hand grip to remove the snow from the ground. The load is then easily supported on the mechanically pivoted shovel with its favorable lifting leverage and balanced load position whereupon the wheeled base can be moved to a desired dumping location for the snow. The hand grip for the shovel handle can then be rotated in a circular motion about its longitudinal axis to discharge the snow from the shovel blade at any desired point. The supporting wheels in an embodiment are air inflated similar to conventional bicycle tires and have a diameter about one-half of the length of the support pedestal connecting between the shovel handle support sleeve and the wheel axis. The pivot point of the mounting of the shovel handle is about waist high on an adult operator so that the load of snow can be comfortably wheeled to a point of disposal and positioned over the desired point or location for discharge of the snow and the shovel handle rotated to dump the load of snow from the blade. In some embodiments the length of the support pedestal is adjustable to accommodate the height of different operators. If the snow sticks to the shovel blade, the shovel blade can be jarred against the ground or jiggled by the operator upon its support or pedestal to discharge the load of snow. The steering wheel shaped section of the hand grip which is preferably mounted extending from the upwardly facing portion of the shovel handle aids the operator in rotating the shovel handle to dump loads of snow from the shovel blade, as well as in controlling the movement of the entire wheeled shoveling device. In some embodiments the shovel handle support sleeve is detachable from the wheeled support while in other embodiments the wheels may be moved to a storage position in closer proximity to one another.

OBJECTS OF THE INVENTION

It is a principal object of the present invention to provide a wheeled pedestal mount for a manual type snow shovel by which major stress may be removed from a snow shoveler to enable said shoveler to shovel for longer periods without excessive tiredness and fatigue as well as reducing stress on the heart and avoiding possible physical injury particularly musculoskeletal strains to the lower back, shoulders, arms, and knees of the shoveler.

It is a further object of the invention to provide a shoveling apparatus which will allow a snow shoveler to work at a more rapid pace shoveling snow from exposed surfaces without undue fatigue of the shoveler.

It is a further object of the invention to provide a snow shoveling apparatus which is easy to use and in effect mechanizes the shoveling operation, but also does not use scarce fuel for mechanical or mechanized operation.

It is a further object of the invention to provide a manual snow shoveling or snow clearing apparatus which includes a wheeled carriage easily operated and moved and maneuvered by the operator without the use of powered mechanical assistance.

It is a still further object of the invention to provide a simple mechanical apparatus to simplify and more easily accomplish the frequently exhausting manual labor customarily involved in the clearing of paths and pavement surfaces of snow, ice, and slush cover by a basically manual shoveling apparatus, yet incorporating simple but effective mechanical assistance.

It is a still further object of the invention to provide a snow shovel accessory by which the labor of the manual clearing or shoveling of snow cover can be accomplished quickly and easily without excessive manual labor or injury to the shoveler's body.

It is a still further object of the invention to provide a wheeled carriage assembly to support a snow shovel while shoveling layers of accumulated snow from outdoor surfaces that in use provides healthful exercise to the average shoveler's body with a reduced risk of injury to such shoveler's body and particularly to the back muscles and spinal structure of the shoveler.

It is a still further object of the invention to provide an integrated snow shoveling device including a wheeled ground support for the shovel.

It is a still further object of the invention to provide a snow shovel together with an integrated mobile support for said shovel which removes the major portion of the weight of snow collected on the shovel blade from the back musculature of a snow shoveler during lifting, transporting, and dumping of the snow from the shovel blade.

It is a still further object of the invention to provide a mobile support for the weight of snow picked up by a snow shovel.

It is a still further object of the invention to prevent back strain and the usual injuries potentially sufferable by snow shovelers during the clearing of paths and pavements as well as other surfaces during winter weather by providing an auxiliary snow support for use by the shoveler during shoveling without significantly interfering with the efficiency of shoveling.

It is a still further object of the invention to provide a snow shoveling device which can accommodate simultaneous multi axis pivoting of the shovel handle and blade during loading, lifting, transporting, and dumping loads of snow from the shovel blade on a fully controlled basis.

Other objects and advantages of the invention will become evident from review of the description in the specification set forth herein.

DESCRIPTION OF THE PREFERRED EMBODIMENTS

Figure 1:
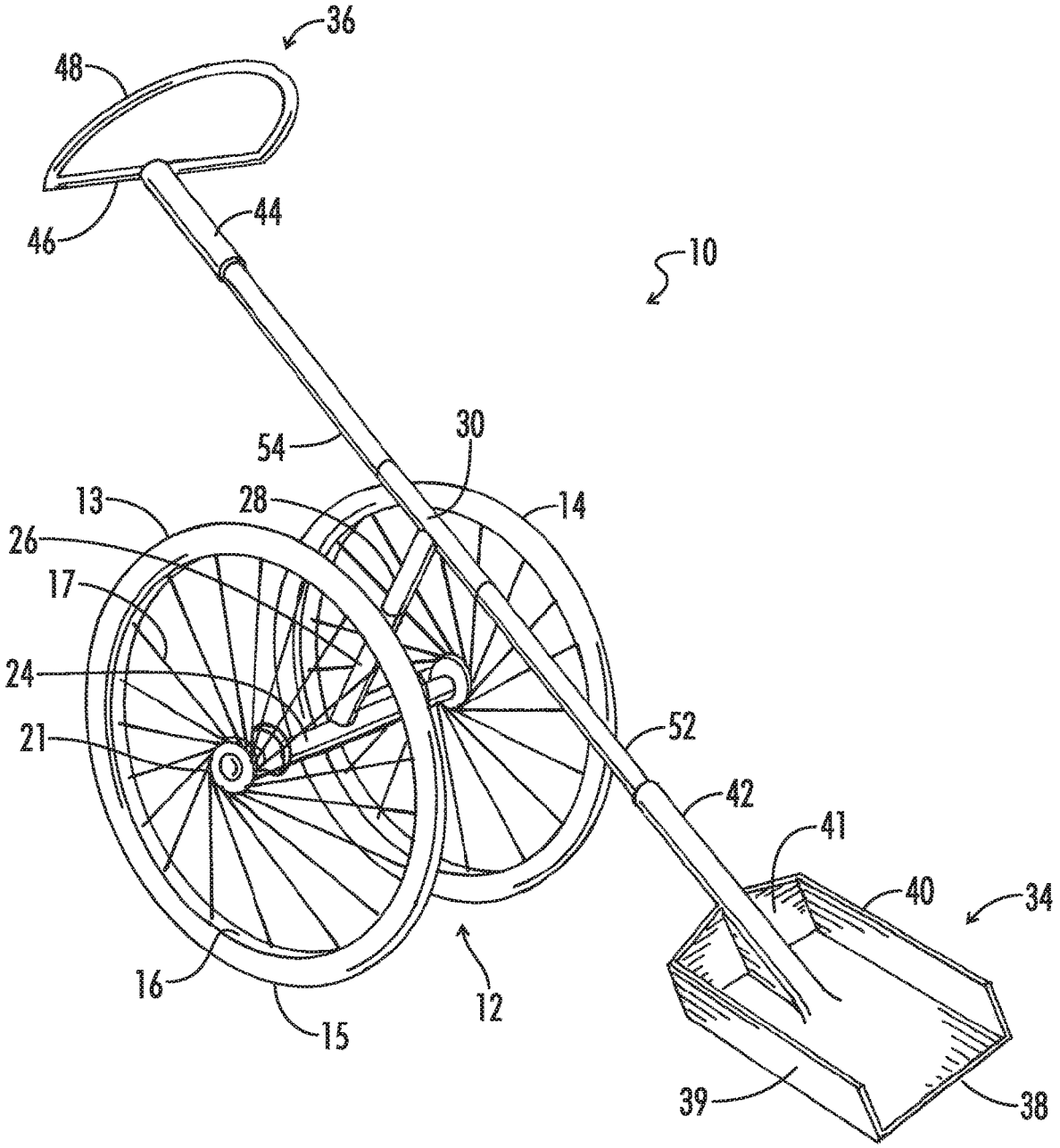
FIG. 1 is a perspective view of a wheeled snow shovel in accordance with an embodiment of the invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and benefits of the invention.

In accordance with the present invention, the efficiency of snow shoveling and the strain on a shoveler's body and particularly on the spine and the back muscles of the shoveler is greatly alleviated through use of the present inventor's shovel apparatus, which provides very effective balanced support of the weight of a load of snow picked up by the shovel apparatus by reason of being lifted and transported upon a hand operated wheeled carriage accommodating pivoted support of the shovel, which pivoted support transfers the majority of weight of the snow from the shovel blade and handle to the ground through the support pedestal, wheel axis, and wheels of the carriage. The snow load collected by the shovel by propelling the shovel blade into an accumulation of snow on the ground may then be disposed of at a chosen collection point by directing such pivoted shovel over such point on a vertical pivoting structure mounted upon the carriage and rotating the shovel handle within a rotary mounting for the handle to dump snow from the shovel blade directly upon the elected dumping point upon the ground. The vertical pivoting structure and rotary mounting enable simultaneous vertical pivoting and rotational pivoting of the shovel handle and blade which movements are controlled by the shoveler manually by a hand grip mounted at the upper or outer end of the shovel handle having a semicircular gripping section. The hand grip also allows the shoveler's hands to be placed in different positions on the hand grip such as in a more pronated position during pushing or pulling of the shovel assembly and in a more neutral position when transporting and rotating the shovel handle to dump a load of snow from the shovel blade, which different hand grip positions enable the shoveler to grip the hand grip with the strongest grip position for the task being completed. The mounting of the shovel allows for full simultaneous multiple axis pivoting of the position of the shovel at all times, without allowing any lateral movement of the shovel handle with respect to the pedestal support, thereby facilitating completely controlled shoveling similar to hand shoveling but without the physical strain because of mechanical support of most of the weight.

The present invention as shown in the appended drawings comprises a lightweight but sturdy two wheeled carriage upon which is mounted in some embodiments a straight handled snow shovel. The wheels are lightly constructed and are large enough to easily roll or pass over accumulations of snow. The shovel is supported on the carriage upon a pedestal, or elevated support, which pedestal is rotatably mounted around an axle structure which extends between the two wheels. The pedestal has a length in some embodiments about equal to half of the diameter of the wheels. At the apex of the pedestal a shovel handle support sleeve is mounted to the pedestal, through which sleeve a straight portion of the snow shovel handle extends. The shovel handle is rotatably mounted upon the pedestal in the support sleeve in a manner which prevent longitudinal movement of the shovel handle within the sleeve. The shovel handle is preferably but not necessarily formed of a rigid plastic material such as rigid polyvinyl plastic and is loosely mounted within the support sleeve, which is preferably formed of a similar polyvinyl tube or abbreviated conduit. The shovel handle is designed to be securely but rotationally or rotatively mounted in the support sleeve, thus allowing the shovel handle in some embodiments to rotate freely within the sleeve in either direction. In other embodiments, the shovel handle will have a sufficient range of rotation to make possible at least a right angle turn of the shovel blade mounted at the end of the handle section in order the user to more effectively shake off a load of snow on the shovel blade. The dumping a load of snow, the shovel handle is again rotated back to a position with the top surface of the shovel blade facing upwardly and ready for use to pick up another load of snow by pressing the shovel blade into such snow accumulation and then lifting the blade by applying a downward force on the hand grip attached to the opposite end of the handle, and the moving the blade to the chosen snow "drop zone" where the blade is again rotated to deposit the load of snow in the designated drop zone or area. The hand grip includes a transverse handle extension forming a first gripping area, and second gripping area formed as a half circle extending between the ends of the first gripping area. The first gripping area is most suitable for pushing the wheeled shovel assembly forward such that the shovel blade engages a load of snow to be picked up, and lifting and pulling the load rearwardly. The second half circular gripping arear of the hand grip may be gripped by one or two hands of the shoveler to better facilitate movement of the shovel assembly when moved in other than primarily a forward and backward direction. The circular gripping area is also preferably used when it is desired to affect a controlled rotation of the handle to dump collected snow from the shovel blade. Due to the overall light construction of the wheeled support portion of the carriage apparatus as well as the somewhat limited capacity of the shovel blade itself, which has a width which is less than the distance between the support wheels, and the balanced position of the handle which is prevented from longitudinal movement with respect to the pedestal, the shovel blade is easily held in a raised position and turned by hand rotation to dump any accumulated snow on the blade off such blade at any location over which the blade may be moved and partially or completely inverted.

Figure 5:
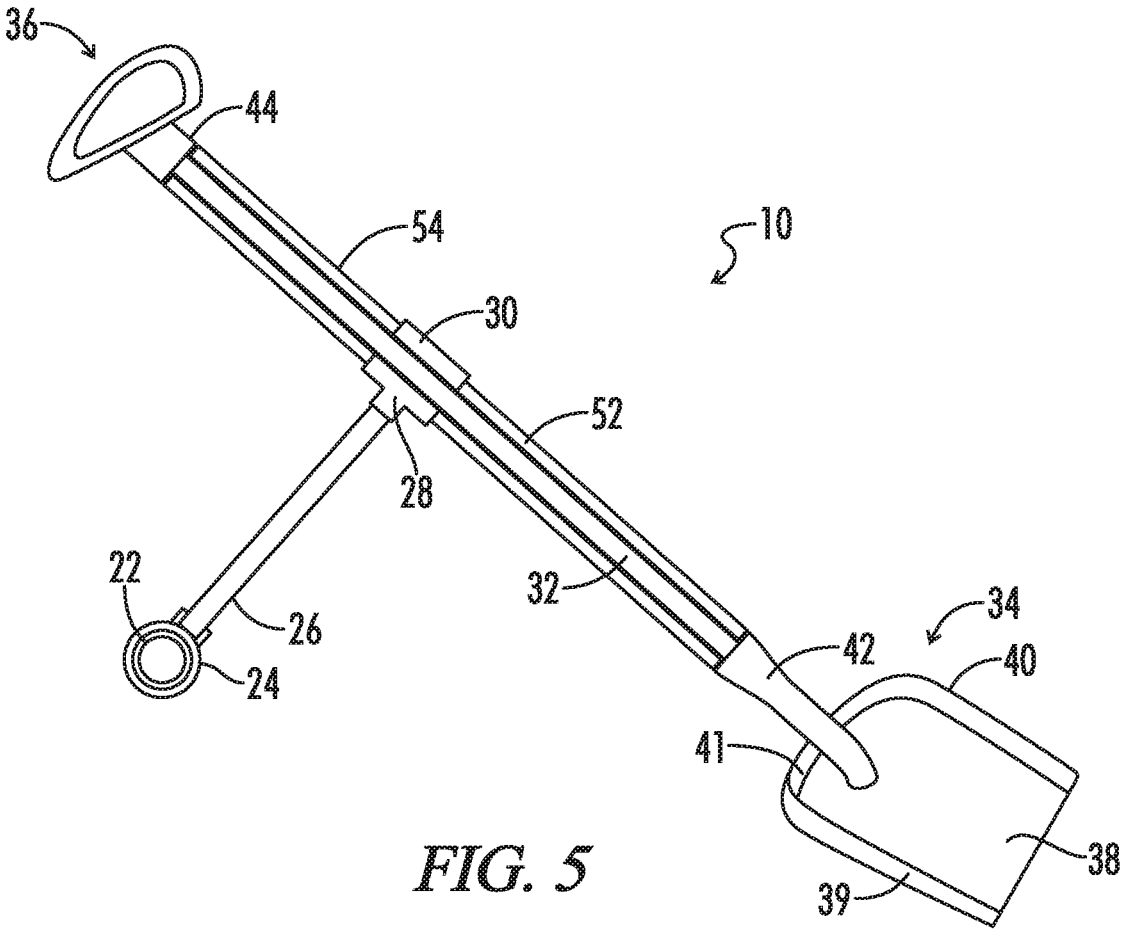
FIG. 5 is a partially cutaway view of an embodiment of the shovel support pedestal.

More particularly describing the wheeled shovel of the invention as will be seen in the accompanying drawing Figs. and referring particularly now to FIG. 1 there is provided a wheeled side dumping mobile snow shovel apparatus 10 having a carriage section 12 which includes two fairly large equal sized spaced-apart wheels 13 and 14 each having preferably inflatable tires or permanently inflated tires 15 mounted upon rims 16 having stressed wire spokes 17 extending between the wheel rim and the central hub 21 of the wheel in the conventional manner. The hub 21 of each wheel is independently rotatably secured to an axle 22 (FIG. 5) connecting between the wheels 13 and 14, and a axle sleeve member 24 is rotatably secured over the wheel axle 22. In other embodiments, the wheels 13 and 14 may be made of other materials such as a lightweight plastic. It will be recognized that the described construction provides a strong but light weight wheel assembly easily moved over a surface even when such surface is covered by a coating of snow. Wheels 13 and 14 have a diameter of between about 24 and 36 inches, and between about 30 inches and about 32 inches will normally be quite satisfactory. The relatively large diameter of wheels 13 and 14 makes them more suitable for easily moving across surfaces on which snow has accumulated and is to be shoveled using the shovel apparatus 10. In some embodiments, the shovel assembly 10 can be provided with the pairs of wheels having different diameters to enable the shovel design a better fit depending upon the stature of the user, it being most convenient if the shovel handle when held in a substantially horizontal position is located at about waist high to the user.

A pedestal or support structure 26 is secured extends outwardly from axle sleeve 24 at a central location between wheels 13 and 14. A shovel support sleeve 28 is connected to the outer end of pedestal 26, the sleeve 28 having a sleeve section 30 including a through-aperture which extends at a right angle with respect to pedestal 26 and which is also aligned in parallel with wheels 13 and 14. Shovel handle 32 (FIG. 5) is in turn positioned in the through-aperture of sleeve section 30 at a middle section of the handle 32. A shovel blade 34 of somewhat restricted size is mounted upon an end of the shovel handle or arm 32. In addition, a hand grip 36 is mounted upon the end of handle 32 opposite blade 34. Cover member or housing 24 is freely rotatable about the axis of wheel axle 22, such that the shovel handle 32 is rotatable on pedestal support 26 about the longitudinal axis of the wheel axle. In addition, handle 32 is freely rotatable in sleeve section 30 such that the hand grip 36 can be maneuvered to rotate the handle 32 and shovel blade 34 in either direction in order to dump a load from the shovel blade 34. The shovel mounting arrangement therefore allows for full simultaneous multiple axis pivoting of the position of the shovel handle 32, as the handle can be rotated about the wheel axis 50 while simultaneously being rotated about its own longitudinal axis within the sleeve 30. In addition, as described in greater detail below, the handle 32 is prevented from any lateral sliding movement with respect to the longitudinal axis of the sleeve 30, so that the handle 32 cannot inadvertently be displaced from a predetermined balanced position on pedestal 26.

The shovel blade 34 has a bottom wall 38 which is preferably surrounded on three sides as illustrated by side and rear walls 39, 40, and 41 respectively, to restrict sliding or passage of snow from the shovel blade unless or until the shovel is rotated to the side by at least somewhat greater than a half of a rotation of the shovel handle 32 so the attached shovel blade 34 ends up at least partially inverted. Shovel blade 34 also includes a handle mount or sleeve portion 42 which is secured over the end of handle 32 to rigidly secure the blade 34 to handle 32. Thus, the degree of rotation of the shovel blade 34 when dumping snow from the blade should normally be somewhat more than 90 degrees or more or between 90 and 180 degrees.

Figure 2:
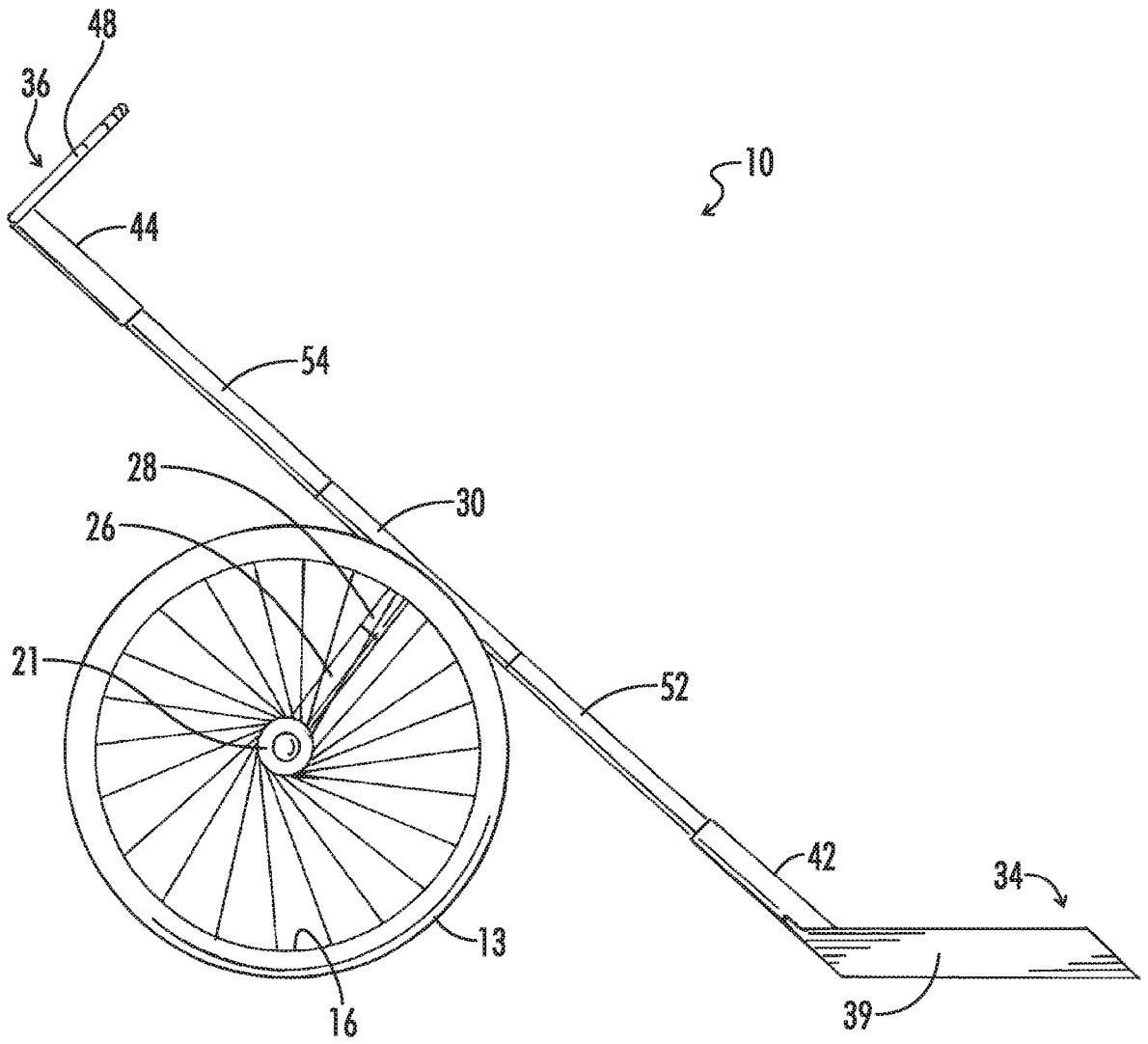
FIG. 2 is a side elevation of the wheeled snow shovel embodiment shown in FIG. 1.
Figure 3:
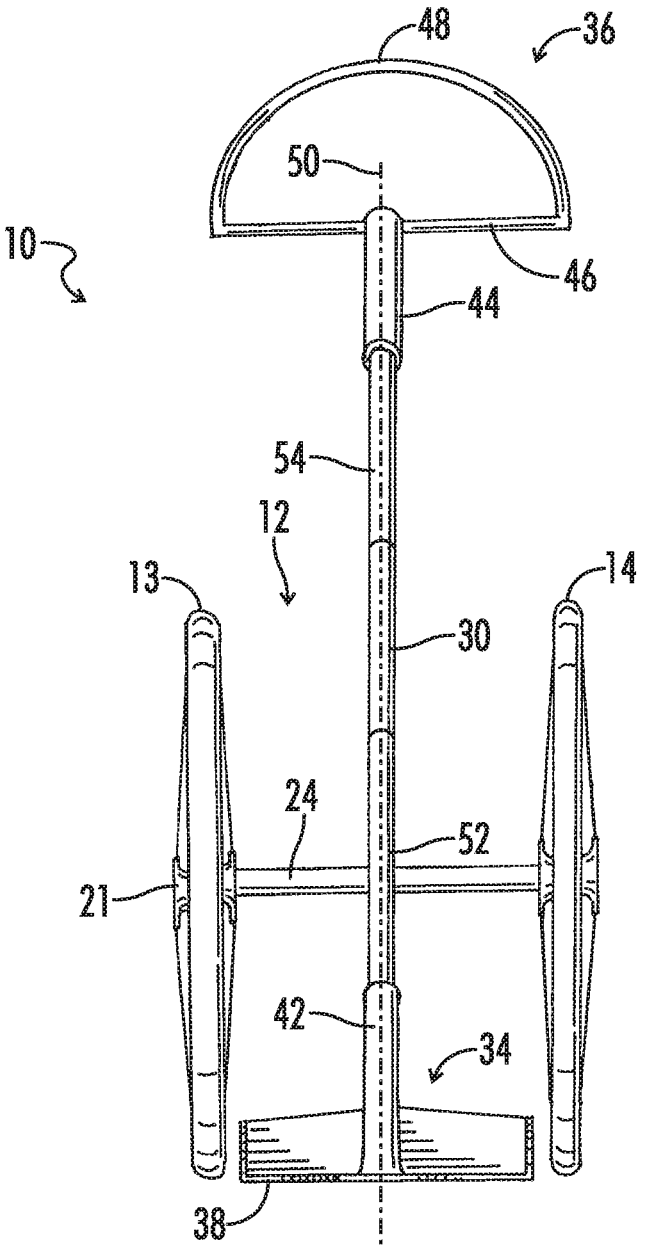
FIG. 3 is a front view of the wheeled snow shovel embodiment shown in FIGS. 1 and 2.
Figure 4:
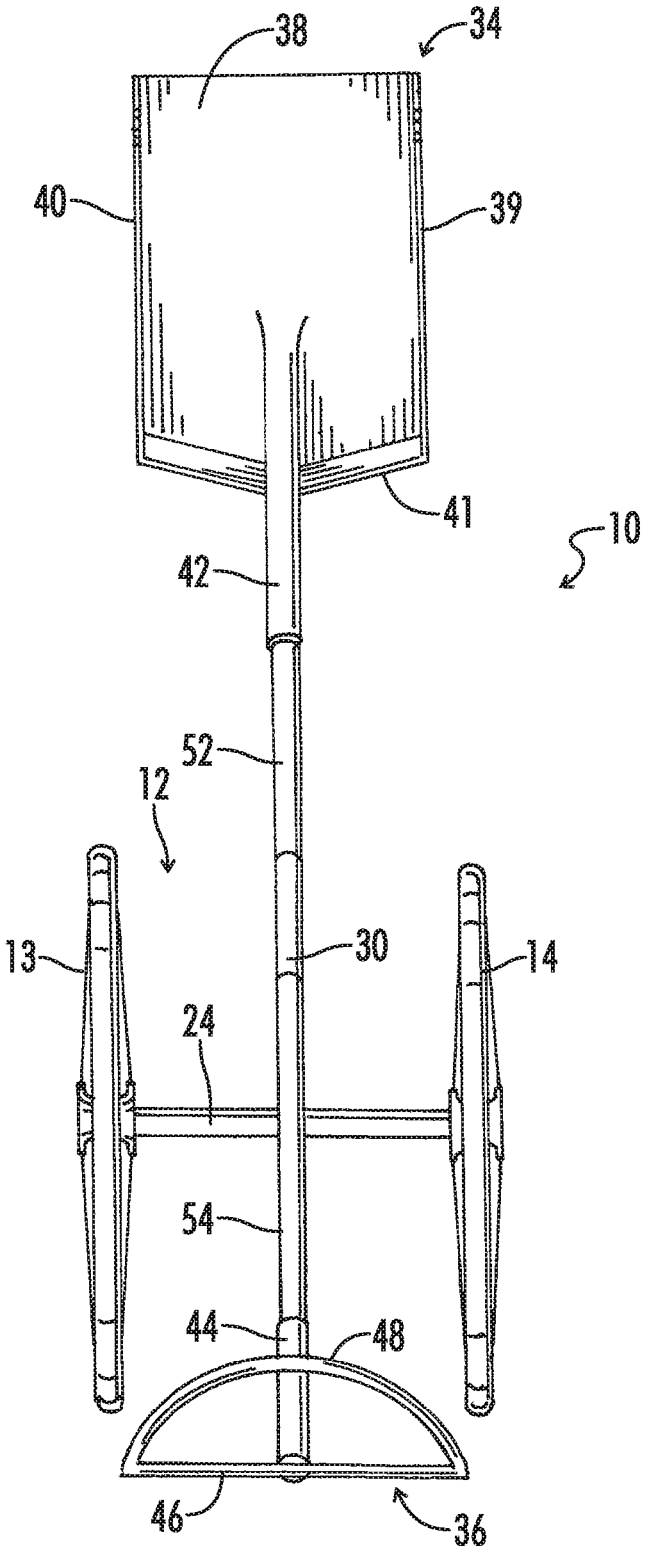
FIG. 4 is a top view of the wheeled snow shovel embodiment shown in FIGS. 1 and 3.

Hand grip 36 also has a handle mount or sleeve portion 44 which fits over the opposite end of handle 32 and which is rigidly secured to the handle. First gripping section 46 extends transverse to handle mount 44 on opposite sides of the handle 32. In addition, hand grip 36 includes an arcuate or semi-circular second gripping portion 48 which is connected extending outwardly from the opposite ends of the transverse first gripping section 46. More particularly, first gripping portion 46 of the shovel handle grip 36, as is clearly shown in FIGS. 3 and 4, is aligned substantially in parallel with the bottom wall 38 of the shovel blade 34, such that when handle 32 is positioned as shown in FIGS. 3 and 4 first gripping section 46 can be gripped with both hands in a pronated position with the palms facing away from the body or downwardly. In addition, the second gripping section 48 of handle grip 36, as best illustrated in FIG. 2, extends upwardly from first gripping section 46 when the handle is positioned as illustrated in FIG. 2. The second gripping section 48 therefore is preferably gripped with the hands in a more neutral position with the palms facing inwardly towards each other.

The first gripping section 46 is relatively short such that when gripped the user's hands are positioned inwardly with respect to the shoulders, which is generally a stronger pushing and pulling position. In a preferred embodiment, first gripping section 46 has a length of about twenty inches or less, and in another more preferred embodiment has a length of sixteen inches or less. Second gripping section 48 is also therefore by design relatively short, such that the user's hands when gripping second gripping section 48 are also within the width of the user's shoulder, which is a stronger gripping position and allows the user to maneuver the shovel apparatus 10 with a lesser effort than otherwise may be possible with other grip configurations. Rotation of the handle 32 therefore does not require undo effort with a firm grip of the rotary or arcuate handle grip section 48 at the opposite end from the shovel blade. In some embodiments, the surface of hand grip 36 may be somewhat rough or less than smooth to increase convenient gripping thereof where necessary. If the snow should be wet and tend to stick to the inside bottom of the shovel blade 34, a gentle shake or jar will usually detach it from the blade 34. However, if the snow, which is often mixed with slush or ice, should be more tightly adherent to the blade 34, such blade can be inverted completely and struck on the ground or pavement to jar the snow pack, or packed-on snow, from the blade just as is frequently done with a normal hand supported shovel.

As can be seen in the appended drawings, since the support pedestal 26 for the shovel is directly supported by the housing 24 for the axle referred to broadly as the wheel mounting or axle cover within which the wheels are mounted rotatively at the end of the supporting axle 22 (see FIG. 6), it follows and can easily be seen in FIG. 1 in particular that the shovel handle 32 is in effect rotatively mounted with respect to the wheels 13 and 14 and the angle of handle 32 can easily be rotated to raise or lower the shovel blade 34, with the axle housing 24 pivoting about the axle 22, with as much speed and effective force as desired. To move the shovel blade 34 upwardly, the user will push downwardly on the hand grip 36, while to lower the shovel blade 34 the user will apply an upward force on the hand grip 36, or simply allow the force of gravity to act on the blade 34 to lower, during which the user may apply a lesser downward force on the hand grip 36 to control the lowering of the blade 34. In addition, the wheels can be infinitely rotated in either direction and while gripping the hand grip 36 the user can apply a forward, rearward or side force on the handle 32 as much as necessary or desired to maneuver or turn the carriage in any direction or angle to pick up and dump snow. In effect, therefore, both the wheels 13 and 14 and the shovel handle 32 are movably, or broadly, rotatively mounted, on the axle 22 although in practical terms the shovel handle 32 is prevented from full rotation about the axle 22 by extension beyond the diameter of the wheels 13 and 14.

By the same token, if it is desired to move the shovel to the side so it can be moved by turning the entire carriage by rotating the wheels 13 and 14 in appropriate opposite directions or, to a lesser extent, by rotation of one wheel at ground level about the other serving as a pivot point. In this instance, if the vertical support or pedestal 26 for the shovel handle 39 upon the axle allowed rotational or pivoted support so the shovel could be swung to the side, the shovel handle 32 might end up partially crosswise to the wheels so the next time it was desired to pick up snow or even to dump snow from the shovel blade 34 it would be necessary to realign the handle of the shovel to be at least more or less equally positioned between the wheels. It is an important characteristic of the present invention, therefore, that the pedestal mounting 26 of the shovel handle 32 and blade 34 not be rotatable or alterable with respect to the direction of the shovel handle 32 between the wheels 13 and 14, but always be maintained at a right angle between the orientation of each wheel 13 and 14 and the shovel handle 32 so the shovel is always movable either directly toward or directly away from the working area or the immediate shoveling site. The fact that the wheels are lightly constructed and have a diameter within a few inches of twice the height of the supporting pedestal upon the axle such that the handle is connected to the pedestal at about waist high on the user enables easy maneuvering of the carriage as a whole to position the snow shovel over or adjacent to any portion of the earth or environment it is desired to operate it in or upon.

Thus, as a general rule the height of the pedestal 26 and sleeve 30 should bring the shovel handle 32 preferably to the level of the top of the wheels in line with the extension of the shovel handle between the wheels and in general for best operation no more than one quarter of a diameter of the width of the wheels and, even more preferably, not more than one eighth of a wheel diameter above or below the rim of the tires of the wheels. It is also necessary that the handle of the shovel not be unbalanced when mounted in sleeve 30 on pedestal 26. Thus, the distance of the shovel handle 32 in front of the wheels 13, 14 should be about the same as the distance of the handle behind the wheels. In addition, once the shovel handle 32 has been properly balanced in sleeve 30, while the handle 32 is permitted to freely rotate in sleeve 30, the handle 32 should be prevented from sliding laterally within sleeve 30, or along the longitudinal axis of the handle 32, in order to maintain such proper balance. It will be understood that since manual forces are applied to one end of the handle 32 by a user gripping the hand grip 36 and pushing or pulling on the hand grip 36 to move the shovel apparatus 10 forward or rearward on wheels 13 and 14, allowing the handle 32 to slide laterally with respect to sleeve 30 would significantly hinder the user's ability to move the shovel apparatus 10 on the wheels quickly and precisely. In particular, since as indicated above the handle 32 is fitted loosely in sleeve 30 so as to rotationally pivotable in sleeve 30, the force required to slide the handle 32 laterally in sleeve 30 would be less than the pushing or pulling force required to be placed on the hand grip 36 and handle 32 to move the wheels in a forward or rearward direction. Further, if the shovel apparatus was pushed forwardly into a load of snow to be picked up and the handle 32 slid forwardly in sleeve 30, when the hand grip is pushed downwardly to lift the load of snow, the handle will not be in a balanced position on pedestal 26, such that the manual force required to lift the load will be much greater than if the handle remained in a balanced position on pedestal 26, thus greatly reducing the desirability and effectiveness of the invention. Even lateral movement of the handle of only an inch or two in the sleeve would cause the user to work significantly harder while operating the shovel apparatus of the invention. Thus, the invention in all embodiments includes a means for preventing lateral sliding of the handle 32 with respect to sleeve 30. It is also preferable that the shovel blade bottom wall 38 be essentially parallel to the ground when the shovel blade 34 is lowered to the ground and that the hand grip at the other end be around the chest area of the user when the shovel blade is in this position. Further, since the position of the shovel handle 34 is fixed to extend straight between the wheels, it is quite important that the wheels 13 and 14 have the characteristic of free rotation, lightweight and reasonable passage upon or through a ground cover of at least several inches of snow. It has been found that these characteristics are very well provided by wire spoked wheels such as are almost universally used upon bicycles and are consequently both reasonable in price and readily obtainable and maintainable.

The arcuate hand grip 36 at the users end of the handle 32 should be positioned at about waist high for the usual or expected user when the shovel of the invention is supported upon the ground or about to be forced into a layer of snow or even a pile of snow. At this position the shovel blade 34 may be then be lifted from the ground fairly easily by pushing down on the arcuate hand grip 36 with the users hands and then first pulling the hand grip 36 and the entire apparatus back and then wheeling it by hand force either rearwardly or sometimes forwardly either by one hand or two hands depending upon the strength of the shoveler. After snow is picked up the entire apparatus may then be maneuvered until the shovel blade 34 is over the spot or location where the load of snow is to be deposited, disposed of or piled, at which point the rotatable handle 32 may be rotated preferably by gripping and rotating the arcuate second gripping section 48 of the had grip 36 to turn the shovel blade and dump the snow.

As indicated above, the shovel handle 32 is rotatably mounted transversely about its longitudinal axis 50 in sleeve 30 upon the supporting pedestal 26 so as to allow at least one-half a rotation, or turn to either side, and preferably more, in order to repeatedly dump collected snow from the shovel blade 34. In addition, the handle 32 must be prevented from lateral movement or sliding with respect to the pedestal 26. It has been found by the present inventor that housing the shovel handle 32 completely within a tubular mounting between the shovel blade 34 and hand grip 36 is most effective in accomplishing this task. More particularly, as shown in the Figs. the ends of the tubular mounting will abut against the inner end of handle mount or sleeve portion 42 of the shovel blade 34 on one end, and against the inner end of handle mount or sleeve portion 44 of the hand grip 36 on the other end. In one embodiment, shown in FIG. 7, the sleeve section 30 of shovel support sleeve 28 mounted on the upper end of pedestal 26 is dimensioned to fully extend between ends of handle mounts 42 and 44 of the blade 34 and hand grip 36, respectively. In this embodiment, the sleeve section 30 in effect serves as an outer sheath in which the portion of the shovel handle 32 between the handle mounts 42 and 44 is enclosed and which is rotatably mounted within this outer sheath, which sheath may be formed of a polyvinyl or the like tubular material. The combination of sleeve portion or outer sheath abutting against the end cap portion of the shovel blade on one end and the end cap portion of the hand grip on the other end prevent the handle 32 from sliding or moving laterally in the sleeve section 30. Narrow spacers may be provided between the ends of the sleeve section 30 and handle mounts 42 and 44 to prevent binding of the handle 32 as it is rotated in the outer sheath, and also to prevent any debris or liquids from working its way in between the ends of the outer sheath and end cap portions. The spacers are also used to maintain the handle centered in the outer sheath. Handle mounts 42 and 44 may be secured over the ends of the handle 32 by a bonding or threaded arrangement as may be preferred, and in addition preferably have an outer diameter which is at least as large as the outer diameter of the sleeve section 30.

In another embodiment, shown in FIGS. 1-4, the ends of the support sleeve 30 do not abut against the end caps or sleeve sections 42 and 44 of the shovel blade 34 and hand grip 36, respectively. Rather, the handle 32 between the inner end of blade mount 42 of the shovel blade 34 and the downwardly facing end of sleeve 30 is covered by a first tubular cover 52, and between the inner end of handle mount 44 of the hand grip 36 and the upwardly facing end of sleeve 30 the handle 32 is covered by a second tubular cover 54.

Since the shovel blade 34 and arcuate hand grip 36 are rigidly secured at opposite ends of the shovel handle 32 the sidewise orientation angle or attitude of the shovel blade 34 with respect to the earth's surface is determined first by the angle of attachment of the blade 34, and in particular the angle of bottom wall 38 to the handle 32, and second by the rotary position of the arcuate gripping section 48 of hand grip 36 at the opposite end of the handle 32. The angle of the shovel handle 32 with respect to the earth is determined by the angle of the pedestal mount 26 with respect to the earth, and the pedestal mount 26 angle is in turn determined by the position of the axle cover or sheath 24 upon the supporting axle, which ultimately is determined by the shovel operator and the position the shovel blade 34 is held, either on or above the ground, by pushing downwardly on the arcuate handle 36. By controlling the position of the arcuate handle the position and the attitude of the shovel blade with respect to the ground is completely determined or controlled by the shoveler with one hand, or two, as may be desired when the shovel may have a complete load of snow supported upon its surface.

The rotary mounting of the shovel handle 32 within sleeve 30 and in some embodiments the first and second outer sheath sections 52 and 54 of the shovel support allows side to side or complete circumferential rotation of the shovel blade 34 by manipulation of the arcuate handle 36 to dump snow from the shovel blade 34 once collected on the shovel blade 34. This enables snow to be piled up at one point or deposited at another in an efficient and easily controlled manner by the shovel operator. However, it is also necessary that the angle of the shovel be easily controlled to determine the correct angle of the shovel blade 37 for picking up an accumulation of snow from the ground. This could be accomplished by pivoting the handle 32 at the apex or top of the pedestal mounting 26. However, it has been unexpectedly found by the present inventor this may be more efficiently and sturdily accomplished by instead journaling the pedestal mounting upon or about the wheel axle 22 to which the wheels which support the carriage are mounted. Thus, as indicated generally already the lower end of the pedestal mount 26 is journaled upon or about the center of the axle cover 24 of the invention so that the pedestal mounting 26 itself may be rotated forwardly about the axle when it is desired to pick up snow from the ground or other surface upon which the shovel is placed, and may be straightened up when the snow is to be picked up to elevate the shovel blade 34 above the ground. In fact, if it is desired to raise the collected snow higher than the normal height of the pedestal or shovel handle support from the axle the shovel handle 32 can be inclined even higher. In addition, since the shovel blade 34 is not pivoted from the top of the pedestal, but is pivoted directly from the axle mount, the arrangement is sturdier and avoids possible contact with and interference between the large wheels of the carriage 26 and the shovel handle 32 during snow shoveling.

It is important to the construction and use of the present invention that the movement of the wheeled base upon which the pedestal mounting of the rotatable shovel handle is mounted be freely movable or rotatable to any position by independent rotation of the two wheels 13 and 14 upon the connecting shaft or axle 22 upon which the wheels are mounted shall be freely and independently rotatable such that the wheeled cart will be fully maneuverable forward and backward as well as to the side by the steering and rotating hand grip 36 and that the shovel handle 32 mounted thereupon be rotatable circumferentially about its longitudinal axis or as it is supported upon the pedestal 26 mounted upon the axle mounting 24 of the wheeled carriage or mobile support of the shovel.

Figure 6:
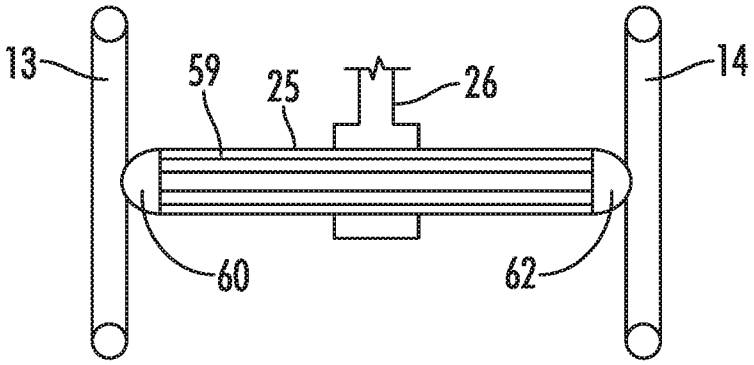
FIG. 6 is a cutaway view of a possible axle construction for the wheeled shovel support of the invention.

FIG. 6 is a partially cut-away view of a possible construction of the wheel carriage and axle in which a rigid polyvinyl tube or pipe has a round polyvinyl rod 59 passing through the center of wheel mounting 25 which may constitute a one and a quarter inch polyvinyl plastic rod within an outer polyvinyl tube about one eighth inch larger in internal diameter than the outside of the internal rod. The ends of the rod mount polyvinyl end caps or wheel mountings 60 and 62 to which the wheels 13 and 14 of the shovel carriage may be rotatively mounted, respectively. The described construction of the carriage of the invention is sturdy and long lasting for a device which only usually has intermittent use and is more subject to atmospheric deterioration than to physical wearing out by use.

Figure 7:
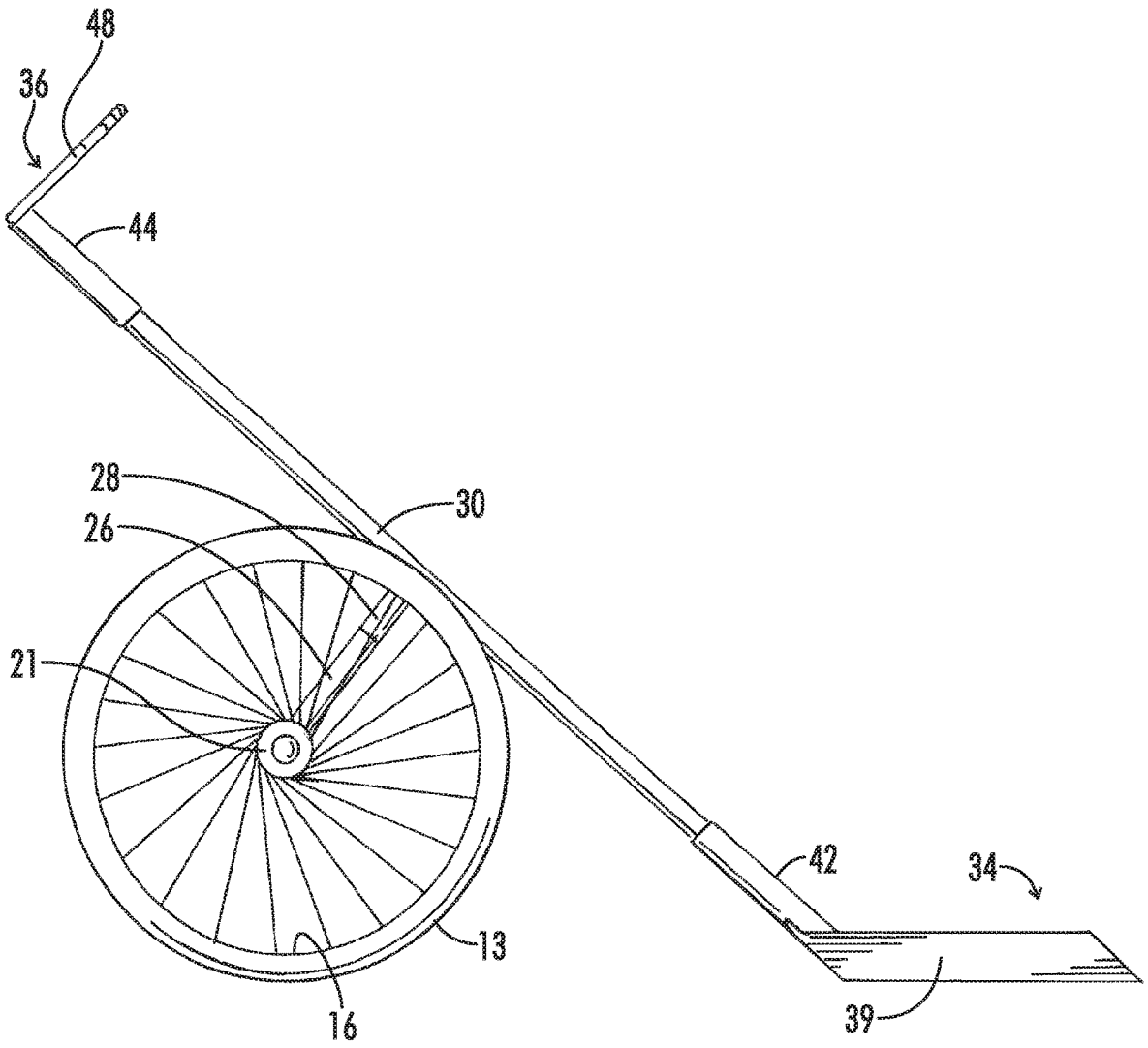
FIG. 7 is a side elevation view of another embodiment of the invention in which the outer sheath in which the shovel handle is rotatably mounted extends between the shovel blade and hand grip handle mounts.

FIG. 7 illustrates the wheeled shovel 10 of the invention as shown in FIG. 1 except as indicated above sleeve 30 is shown extended on one end to abut against blade mount 42 and on the other end to abut handle mount 44. Thus, when hand grip 36 is manually grasped and pushed forwardly such that the wheels 13 and 14 turn and the shovel blade 34 is pushed forwardly into a pile of snow, handle 32 which is rotatably housed in sleeve 30 will be prevented from sliding laterally in the sleeve, or stated another way, along the longitudinal axis 50 of the handle 32. In addition, rather than using the shovel apparatus 10 in the manner just described where the shovel blade is pushed into a pile snow so that a load of snow is accumulated on the bottom surface 38 of the blade, alternatively the shovel handle 32 can be rotated in sleeve 30 180 degrees such that the shovel blade 34 is upside down as compared to the orientation in FIG. 7. In this "upside down" position, the shovel apparatus 10 can be operated in a manner similar to a conventional roof shovel wherein rather than pushing the shovel blade forwardly into a pile of snow to accumulate a load on the shovel blade, the shovel blade is instead pulled rearwardly through the snow to clear the snow off of a surface. This arrangement is particularly useful it has been found in clearing snow from a porch, steps, or other elevated surfaces whereby the snow is essentially pulled off of the porch or steps on to the driveway or pavement, where it is picked up by the shovel apparatus 10 in the manner described above. To facilitate such "pulling" type snow clearing from elevated surfaces or the like, the inventor has provided small wheels 80 along the front edges of the side walls 39 and 40 of the shovel blade, respectively. Such wheels 80 may be attached to walls 39 and 40 in a conventional manner such as riveting, and are positioned such that they will contact the surface being cleared when the shovel blade is used in a "pulling" manner as just described, and will aid in allowing the blade to be pulled over those surfaces which are not level or are uneven.

Figure 8:
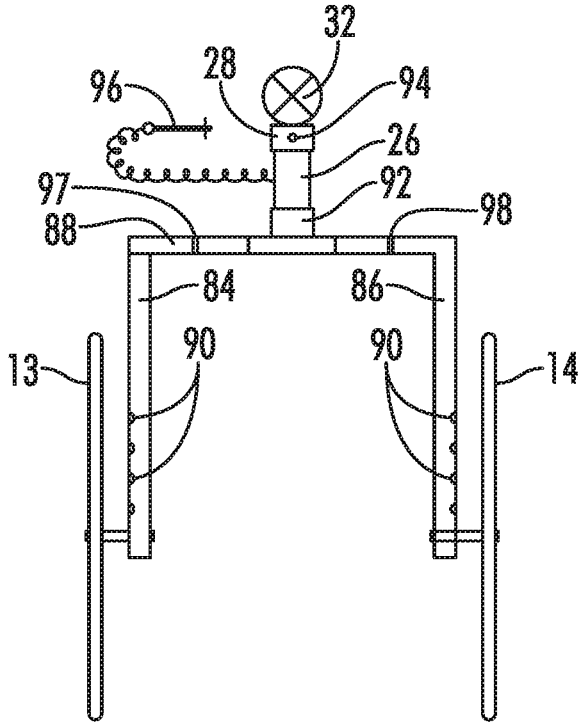
FIG. 8 is a side elevation view of another embodiment of the invention in which the height of the support pedestal is adjustable and the shovel handle support sleeve is detachable from the wheeled carriage.

FIG. 8 illustrates a wheeled shovel carriage for the shoveling apparatus 10, which in the present embodiment has been modified to allow the wheels 13 and 14 to be secured at different vertical positions on the carriage frame, providing an arrangement for quickly and easily adjusting the height of the shovel handle 32 to a comfortable height for persons of different statures. In addition, different size wheels can be quickly and easily connected to the shovel apparatus carriage. Rather than having an axle 22 extending horizontally between the wheels 13 and 14 as in FIG. 1, the wheels are separately connected to vertical members 84 and 86 of a U-shaped framework having a horizontal tubular member 88 connecting between the upper ends of verticular members 84 and 86. Each vertical member 84 and 86 includes a series of spaced apart mounting holes 90 which are vertically aligned such that the wheels can be connected to the vertical members 84 and 86 by passing a connector such as an axle pin into the wheel and the mounting holes. The axle housing in the previous embodiments is replaced by a sleeve 92 which is rotatably secured to horizontal member 88 at a central location. Pedestal 26 in the present embodiment is shorter than in the prior embodiment, as the horizontal member 88 is in an elevated position as compared to axle housing 22. In this manner the wheeled shovel apparatus can be mass produced while still being available in different sizes to fit the particular needs of the individual purchaser.

Figure 9:
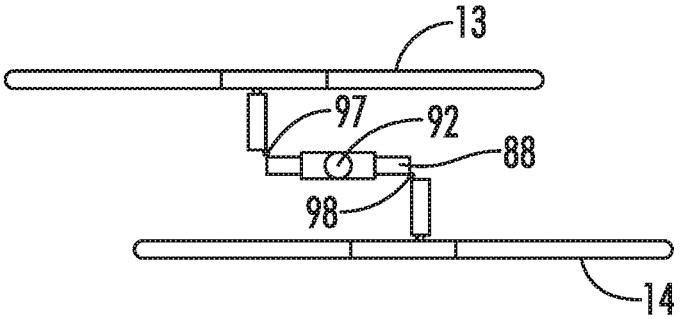
FIG. 9 is a top view of an embodiment of the wheeled carriage pivoted into a compact storage position.

Also in FIG. 8, shovel support sleeve 28 which is secured to the upper end of pedestal 26 is detachable from pedestal 26 in the present embodiment, such that the shovel section of the apparatus is detachable from the carriage section when the device is not in use. Aligned apertures 94 are provided in support sleeve 28 and pedestal 26 through which a pin member 96 such as a drift pin is inserted to connect the carriage and shovel sections, which pin is removed when it is desired to separate the shovel and carriage sections. In addition, as shown in FIGS. 8 and 9, the U-shaped frame may be folded in order to bring wheels 13 and 14 closer together into a more compact storage configuration. In the illustrated arrangement first and second pivot links 97 and 98 are provided in horizontal member 88 which allow the outer sections of the member 88 to be rotated into a position adjacent the opposite sides of the inner section of member 88.

Figure 10:
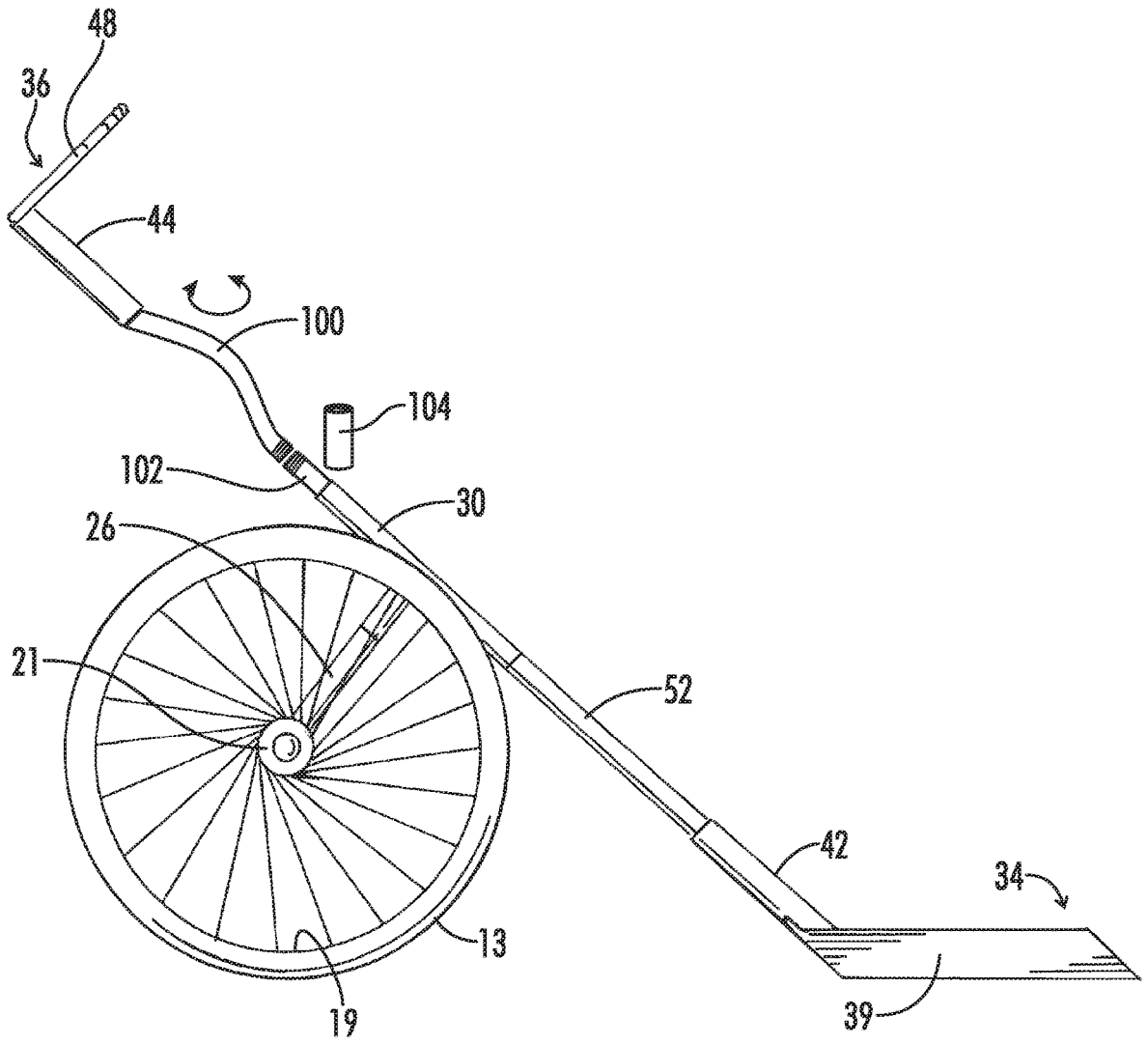
FIG. 10 is a side view of another embodiment of the invention in which the position of the hand grip is variable.

FIG. 10 illustrates another embodiment of the invention in which the upper section of the handle of the wheeled shovel apparatus is curved, and in addition can be locked at least to separate positions in order to vary the height of the hand grip 36. In this embodiment the curved portion 100 is lockable to the straight portion 102 of the handle in two different preferably opposite positions. In one arrangement, a rotatable interlocking arrangement is provided on the ends of the curved and straight portions 100 and 102 which can be varied to adjust the locking position of the curved portion with respect to the straight portion. In another possible arrangement, a threaded or clamping style connection may be provided whereby a sleeve fits over the end of the straight portion and may be loosened and threadably secured to the curved section at different orientations, which will adjust the height of the hand grip 36. The connector 104 would abut against the handle sleeve 30 so as to still prevent lateral sliding of the straight portion. A separate adjustable connector arrangement may be provided between curved portion 100 and the hand grip 36.

The operation of the device of the invention is both easy to learn and carry out and may be used by the young and the old. It is also both healthful to use and inexpensive, not to say less dangerous than other mechanical snow disposal or cleaning devices such as so-called snow blowers, mechanical snow plows and the like. The use of the snow shovel device of the invention also provides healthful outdoor exercise, yet mild exercise which is unlikely to injure the average snow shoveler, while, furthermore, inexpensive relative to gas powered snow blowers. Many people actually enjoy snow shoveling, both because of the exercise obtained, the exposure to an outdoor environment, not to mention the feeling of accomplishment when the snow shoveling task is completed. Yet since snow is only intermittent in most areas of both the United States and the world in general where most of the population lives or resides, the usual shoveler is simply not used to the exertion and may suffer various possible injuries not the least of which are sore muscles, sore and frequently very painfully strained backs, not to mention heart attacks and other serious injuries incident to overexertion and the like. Yet by the use of the mechanical shoveler aid of the invention mild healthful exertion conducive to health and wellbeing can be obtained at a minimum cost in either purchase or temporary use charges. Furthermore, the use of the mechanical shoveler of the invention adds the frequent further interest to many persons of using an intriguing machine or mechanical device for what is frequently seen as an unwelcome and even burdensome chore or task. The fact that shoveling by use of the invention is accomplished more by the use of the novel and intriguing shovel arrangement of the invention than by mere "dogged" shoveling, helps to add an element of interest to the basic shoveling operation, particularly in those areas where snow is not a daily occurrence. In addition, as pointed out above, it is those areas of intermittent need for use of a shovel removal device where the strength of the back muscles and the physiology of the spine of the shoveler is not likely to be accustomed to either sustained or heavy shoveling and therefore where the participants are particularly likely to sustain painful injuries as the result of such shoveling. Among the most likely to be injured by ordinary shoveling are "out of shape" young and medium aged persons and older persons who just do not have the physical capacity for effective sustained shoveling even though they may have deliberately maintained strength and endurance by deliberate physical activities, including, routine exercise and the like.

As will be recognized, for best operation of the snow shovel of the invention as above described, the length of the shovel handle should be suitable both to pick up snow from a surface and should be such that the shovel blade when depressed to its lowest point will be against the surface. At such attitude therefore the height of the handle from the ground will extend to about chest high on the shoveler with respect to a normal sized American male of about five and a half to six feet enabling the shoveler to push down on the shovel handle to raise the snow from the ground for transport to where it is to be dumped by first depressing the handle and wheeling the shovel cart to the proper location where the snow can be dumped by rotating the shovel handle. However, if the shoveler has a small statue the height of the shovel handle may be more than chest high while if the shoveler is very tall, the handle of the shovel when the shovel blade rests flat on the ground may be below the shoveler's hips forcing said shoveler to even assume a continuous bent over position while using the apparatus of the invention. A desirable improvement in the shoveling carriage of the invention, therefore, an embodiment of which is described herein, is to provide an adjustable handle for the convenience and comfort of various sized shovelers. In another arrangement, such adaptability may be attained by having a shovel handle end mounted on a slide arranged so that the end of the handle may be slid in or out of the main portion of the handle to adjust the overall length. Alternatively, as shown in FIG. 8, the pedestal mounting may be adjustable to allow for variations of the height of shovel pivoting from the rotation point upon the axle.

While the present invention has been described at some length and with considerable particularity with respect to the several described embodiments and particularly with respect to the particular and principal intended embodiment, it is not intended that it should be limited to any such particulars or embodiments or any particular preferred embodiment but is to be construed with reference to the particular appended claims so as to provide the broadest possible interpretation of such claims in view of the prior art and, therefore, to effectively encompass the effective and intended scope of the invention with respect both to apparatus for practicing the invention and to methods of performing and practicing the invention.

What is claimed is:

1. A wheeled shoveling apparatus for removing accumulations of snow from a supporting surface comprising:

(a) an elongated handle having a longitudinal axis, (b) a shovel blade mounted at other than a right angle upon an end of the elongated handle by a socket-type interconnection, said shovel blade having a bottom wall including an upper surface and lower surface, (c) a hand grip rigidly mounted upon the elongated handle opposite the shovel blade also by a socket-type interconnection, said elongated handle being rotatably journaled within a tubular mounting, the tubular mounting surrounding the elongated handle between the socket-type interconnection of the shovel blade to the elongated handle on one end, and the socket-type interconnection of the hand grip to the elongated handle on another end, preventing lateral movement of the elongated handle relative to the tubular mounting, (d) the tubular mounting being connected to a support pedestal journaled on an end to a sleeve member of a wheeled carriage and enabling the tubular mounting and elongated handle to pivot so as to move vertically with respect to the wheeled carriage, (e) the wheeled carriage including a horizontal member, and a vertical member connected to each end of the horizontal member, forming a U-shaped framework, each vertical member having a series of spaced wheel mounting holes and having adjustably mounted thereupon large independently rotatable wheels each having a peripheral edge and a diameter, the sleeve member rotatably connected to the horizontal member, and first and second pivot links in the horizontal member positioned on opposite sides of the sleeve member to facilitate pivoting of outer sections of the horizontal member to move the carriage into a more compact storage position, (f) the tubular mounting positioned with respect to the peripheral edge of the wheels no more than one quarter of said diameter above or below the peripheral edge, and the shovel blade assuming a position or attitude essentially parallel to the supporting surface from which said accumulation of snow is to be removed when the lower surface of the shovel blade is in direct contact with said supporting surface, (g) the hand grip including a transverse rod section forming a first hand gripping section and a generally semicircular section aligned with and extending between the ends of the transverse rod section forming a second hand gripping section, the second hand gripping section directed upwardly with respect to the handle when the lower surface of the shovel blade is facing downwardly and having a sufficient diameter to provide leverage to effect manual rotation of the handle and blade about the longitudinal axis of the handle.

2. A shoveling apparatus in accordance with claim 1 wherein the large wheels on said wheeled carriage have balloon tires similar to bicycle tires.

3. A shoveling apparatus in accordance with claim 1 in which the mounting of the handle is no more than one-eighth of a diameter of the width of the wheels above or below the peripheral edge of the wheels.

4. A shoveling apparatus in accordance with claim 3 in which the mounting of the handle is aligned with the peripheral edge of the wheels.

5. A shoveling apparatus in accordance with claim 4 in which the diameter of the wheels is between about 30 and about 32 inches.

6. A shoveling apparatus in accordance with claim 4 in which the diameter of the wheels is about twice the length of the supporting pedestal.

7. A shoveling apparatus in accordance with claim 1 in which the shovel blade additionally comprises a pair of side wall and a rear wall connecting between the side wall along a peripheral edge of the bottom wall.

8. A shoveling apparatus in accordance with claim 1 in which the socket-type interconnection of the shovel blade and hand grip includes a sleeve portion that is secured over an end of the handle.

9. A shoveling apparatus in accordance with claim 1 in which the second gripping section is configured to be gripped in a neutral position with a user's palms facing inwardly and within the width of the user's shoulders.

10. A shoveling apparatus in accordance with claim 1 in which the tubular mounting is detachably connected to the pedestal, and additionally comprising aligned apertures in the tubular mounting and the pedestal through which a pin member is detachably secured to connect the pedestal and the wheeled carriage to the shovel mounting.

11. A side-dumping wheeled shoveling apparatus comprising:

(a) an elongated handle;

(b) a shovel blade including a sleeve portion that is secured over one end of the handle;

(c) a hand grip including a sleeve portion that is secured over an opposing end of the handle;

(d) a carriage having U-shaped framework including a horizontal member, a vertical member connected to each opposite end of the horizontal member, a series of wheel mounting holes formed in each vertical member, a pair of wheels detachably securable to the vertical members, and first and second pivot links in the horizontal member enabling outer sections of the horizontal member and each vertical member to pivot between a use position and a more compact storage position, and (e) a shovel support structure extending outwardly from the carriage, and a shovel support sleeve detachably connected to the support structure and aligned in parallel with the wheels, the support sleeve surrounding the elongated handle between the sleeve portions of the shovel blade and hand grip so as to prevent lateral movement of the elongated handle relative to the support sleeve while permitting free rotation of the elongated handle within the support sleeve.

12. A wheeled shoveling apparatus comprising:

an elongated handle, a shovel blade mounted to an end of the elongated handle, a hand grip mounted to another end of the elongated handle, the elongated handle positioned within a tubular mounting and being rotationally pivotable with respect to the tubular mounting, a support pedestal connecting between the tubular mounting and a horizontal member of a wheeled carriage including a pair of independently rotatable wheels such that the support pedestal and the tubular mounting can pivot so as to be moved vertically, and the horizontal member having an inner section and opposite outer sections connected to the inner section by pivot links, wherein the outer sections and the wheels are pivotable on said pivot links into a more compact storage configuration in which the outer sections are in a position extending along opposite side surfaces of the inner section.

13. The wheeled shovel apparatus of claim 12 in which the elongated handle is secured within the tubular mounting so as to inhibit lateral movement of the elongated handle relative to the tubular mounting.

14. The wheeled shovel apparatus of claim 13 in which the hand grip includes a transverse rod section aligned with the shovel blade and a generally semicircular section aligned with and extending between the ends of the transverse rod section.

* * * * *